United States Patent [19]

Ohishi et al.

[11] Patent Number: 4,977,053

[45] **Date of Patent: * Dec. 11, 1990**

[54] MAGNETIC-SHELL-COATED TONER

[75] Inventors: Masao Ohishi, Neyagawa; Katsuaki Kida, Toyonaka; Katsukiyo Ishikawa, Kuze; Takao Saito, Toyonaka; Kouichi Nagata, Neyagawa, all of Japan

[73] Assignee: Nippon Paint Co., Ltd., Osaka, Japan

[ * ] Notice: The portion of the term of this patent subsequent to Mar. 28, 2006 has been disclaimed.

[21] Appl. No.: 414,729

[22] Filed: Sep. 29, 1989

Related U.S. Application Data

[63] Continuation of Ser. No. 210,183, Jun. 22, 1988, abandoned, which is a continuation-in-part of Ser. No. 068,158, Jun. 30, 1987, abandoned.

[30] Foreign Application Priority Data

Jun. 30, 1986 [JP] Japan ..... 61-154842

[51] Int. Cl.[5] ..... G03G 9/083; G03G 9/093

[52] U.S. Cl. ..... 430/106.6; 430/138; 430/903

[58] Field of Search ..... 430/106.6, 138, 903

[56] References Cited

U.S. PATENT DOCUMENTS

| | | | |
|---|---|---|---|
| 3,318,697 | 5/1967 | Shrewsbury | 430/138 X |
| 4,199,614 | 4/1980 | Ziolo | 430/903 X |
| 4,329,415 | 5/1982 | Ikeda et al. | 430/903 X |
| 4,477,319 | 10/1984 | Mbe et al. | 428/900 X |
| 4,536,462 | 8/1985 | Mehl | 430/106 |
| 4,601,967 | 7/1986 | Suzuki et al. | 430/106 X |
| 4,816,364 | 3/1989 | Oishi et al. | 430/106.6 X |

FOREIGN PATENT DOCUMENTS

| | | | |
|---|---|---|---|
| 51-30743 | 3/1976 | Japan | 430/106.6 |
| 54-51533 | 4/1979 | Japan | 430/903 |
| 58-153950 | 9/1983 | Japan | 430/138 |
| 59-223452 | 12/1984 | Japan | 430/106.6 |
| 59-223454 | 12/1984 | Japan | 430/106.6 |
| 59-229569 | 12/1984 | Japan | 430/106.6 |
| WO83/03920 | 11/1983 | PCT Int'l Appl. | |

*Primary Examiner*—Roland E. Martin

*Attorney, Agent, or Firm*—Wenderoth, Lind & Ponack

[57] ABSTRACT

Disclosured is a toner comprising colored particles and a magnetic shell coated thereon, wherein said colored particles are composed of a binder resin and a coloring agent, and said magnetic shell is formed from an iron-oxide type magnetic material. The toner can be fixable at a low temperature or a low pressure, but the toner particles do not agglomerate with each other during long-term storage.

7 Claims, No Drawings

MAGNETIC-SHELL-COATED TONER

This application is a continuation of of now abandoned application Ser. No. 07/210,183 filed on Jun. 22, 1988 which, in turn, is a continuation-in-part of Ser. No. 07/068,158 filed on Jun. 30, 1987 and now abandoned.

FIELD OF THE INVENTION

The present invention generally relates to a toner used for developing a magnetic latent image in magnetography and an electrostatic latent image in electrostatic printing and electrophotography and the like; and more particularly to a toner having magnetic shell.

BACKGROUND OF THE INVENTION

Conventionally, two types of methods have been known for developing an electrostatic latent image in electrophotography and electrostatic printing. One method is a two-component-type system wherein colored resin powder called "toner", and a carrier composed of iron powder, glass beads and the like are rubbed together to make the toner charged; then the charged toner is electrostatically attracted on an electrostatic latent image of a photosensitive member so as to develop the image. The other method is a one-component-type system wherein a carrier is not used; instead, a toner obtained by means of melting and kneading the following materials, such as binder resin, coloring agent, and magnetic powder, is used for developing a image. In both methods, a fixing process whereby a toner is transferred and fixed on a copy paper, is indispensable. There are two types of fixing methods; one is a heat-roller-fixing method wherein an image is melted and fixed by a heat roller; the other is a pressure-fixing method wherein an image is fixed by pressure.

In recent years, energy saving in both fixing methods is strongly demanded, i.e., improvement in low-temperature performance for the heat-roller-fixing method, and improvement in low-pressure performance for the pressure-fixing method are required. To cope with the above-described demands from the aspect of a toner design, a glass-transition temperature of the binder resin can be lowered in order to achieve low-temperature fixability; however, on the other hand, the use of the resin having a low glass-transition temperature causes the agglomeration of the toner. Consequently, the toner forms an agglomerate during storage, or electric charge quantity decreases due to the lowered flowability in the developing machine.

As for the pressure-fixing method, various methods have been proposed, such as Japanese Patent Publication Open to Public (hereinafter referred to as Japanese Patent O.P.I Publication), No. 14260/1982, No. 146261/1982, No. 41648/1982, and No. 44155/1982. According to the proposed methods, a toner is obtained by melting and dispersing magnetic powder in wax followed by grinding and classifying into fine particles, and then dispersing the fine particles in a liquid solution which has dissolved a resin, such as polystyrene, followed by spray-drying. According to this method, however, the particles stick together because of softening the surface resin thereof when spray-dried. Even if the size of the core material may be made the same, the particle-size distribution becomes large because of the sticking and the charge quantity fluctuates, thus causing deteriorated image quality.

Also, as described in Japanese Patent O.P.I. Publication No. 25156/1986, a capsule toner can be obtained through the following procedures; First, porous polymer particles are dispersed in an aqueous medium containing metal salt mainly composed of iron salt to precipitate metal hydroxides or oxides on the polymer particles (core particles) and then the precipitated polymer particles are used as seed particles to polymerize in an aqueous solution containing a polymerizable monomer to form the capsule toner. According to this method, however, the metal oxide layer formed on the core particles is formed only by precipitation. Therefore, the layer thickness of the metal oxide is limited, and the quantity of the magnetic material present on the surface of polymer particles depends on the surface area of the particles. Accordingly, in order to increase the surface area, the polymer particles have to be made porous. However, to make the polymer particles porous, extremely large amount of a crosslinking agent must be used. Consequently, it is impossible to provide the heat-roller fixability or pressure fixability to the polymer particles. Therefore, in order to provide fixability to the toner, it is required to further form a resin layer on the surface of the polymer particles (core particles). However, in order to ensure low-temperature fixability or low-pressure fixability, glass-transition temperature of the further formed resin layer on the surface of the particles have to be lowered, whereby blocking resistance is deteriorated.

SUMMARY OF THE INVENTION

The inventors of the present invention have found that the cohesiveness and stickiness of a toner can be prevented by means of forming magnetic shell having a thickness of 0.001 to 1 micron, preferably 0.005 to 0.5 micron on the surface of colored particles mainly composed of a coloring agent and a binder resin.

In short, the object of the present invention is to provide a magnetic-shell-coated toner used for heat-roller fixing. The toner is fixable at low temperatures, and the surface of the particles are uniformly magnetized and stably charged.

Also, another object of the present invention is to provide a magnetic-shell-coated toner for pressure fixing. The toner is fixable at low pressure, and the surface of the particles are uniformly magnetized and stably charged.

Furthermore, another object of the present invention is to provide a thermally and mechanically stable toner which does not agglomerate in a long storage or long-period operation.

The magnetic-shell-coated toner of the present invention is preferably obtained by an electroless ferrite plating method.

DETAILED DESCRIPTION OF THE INVENTION

Colored particles used in the present invention which are mainly composed of a binder resin and a coloring agent, are usually obtained by a melt-kneading method or a particulated polymerization method (such as, an emulsion polymerization method and a suspension polymerization method). The particle diameter of the colored particles is usually 2 to 30 micron, preferably 5 to 20 micron. When the particle diameter is under 2 micron, the flowability of the obtained colored particles becomes too low. When the particle diameter is over 30 micron, the image quality is deteriorated.

In the melt-kneading method, a coloring agent or other additives such as wax and the like, if necessary, are melted and dispersed in the binder resin, and then they are ground so as to obtain colored particles. Example of the binder resin is a polymer or copolymer of styrene or styrene derivatives, such as polystyrene, polyvinyltoluene, styrene-butadiene copolymer, styrene-acrylic acid copolymer, styrene-maleic anhydride copolymer; acrylic resin; polyester resin; epoxy resin; xylene resin; ionomer resin; ketone resin; terpene resin; phenol-modified terpene resin; rosin, rosin-modified resin; maleic-acid-modified phenol resin; petroleum resin; polyvinyl alcohol; polyvinyl pyrolidone and a mixture thereof.

Examples of the coloring agents are Carbon Black, Nigrosine, Lamp Black, Aniline Blue, Calcoil Blue, Ultramarine Blue, Phthalocyanine Blue, Chrome Yellow, Quinorine Yellow, Du Pont Oil Red, Rose Bengal, Methylene Blue Chroride and the like.

In the emulsion polymerization method, colored particles are obtained through the following procedures: Usually, a part of a polymerizable monomer and a polymerization initiator are added in ion-exchanged water which may contain an emulsifying agent, and the mixture is agitated and emulsified; then, the rest of the polymerizable monomer is gradually added dropwise to obtain polymer particles having a particle diameter of 0.2 to 1 micron. The polymer particles obtained in this manner are used as seeds for seed polymerization wherein another polymerizable monomer mixture in which dye pigment is dissolved or dispersed is used. Also, the polymer particles are used for seed polymerization wherein another polymererizable monomer mixture does not contain a coloring agent and then the polymer particles are colored by means of a dye solution or a dye-dispersed solution to obtain colored particles.

Any type of polymerizable monomers may be used for emulsion polymerization, examples of which are ethylene, propylene, styrene, alpha-chlorostyrene, alpha-methylstyrene, 4-fluorostyrene, acrylic acid, methacrylic acid, acrylonitrile, acrylamide, methyl acrylate, methyl methacrylate, ethyl acrylate, butyl acrylate, butyl methacrylate, trifluoroethyl methacrylate, vinyl acetate, maleic anhydride and a mixture thereof.

In addition, other additives include a polymerization initiator, emulsifying agent and the like. The polymerization initiator includes two types of polymerization initiator; a free radical initiator, such as hydrogen peroxide, peracetic acid, azobisisobutyronitrile, t-butylhydroperoxide, ammonium persulfate, potassium persulfate; a redox initiator, such as sodium persulfate-sodium formaldehydesulfoxilate, and hydrogen peroxide-ascorbic acid. The emulsifying agent includes an anion surfactant, for example, potassium stearate, potassium oleate, sodium dodecylsulfonate, and sodium laurate and the like; a cation surfactant, for example, a long-chain quaternary amine salt and the like; and a nonion surfactant, for example, an ethylene oxide condensate of linoleinic acid and lauric acid and the like.

According to the present invention, magnetic shell composed of iron oxide is formed on the surface of the colored particles. In other words, colored particles are protected by encapsulating with a magnetic shell. Accordingly, those materials which are considered difficult to be used for a toner due to low glass transition temperature can be also employed for a binder resin of the colored particles. The binder resin conventionally used for a toner has a glass transition temperature of 40° to 80° C. According to the present invention, the glass transition temperature can be extend to a range of 20° to 80° C., preferably 35° to 70° C. The magnetic material formed on the colored particles is, in general, ferrite or magnetite.

The method of forming magnetic material is preferably a electroless ferrite plating method described in Japanese Patent O.P.I. Publication No. 111929/1984 (P39–48 "FUNCTIONAL MATERIAL" September 1984).

In this patent publication, it is only exemplified that the ferrite wet plating method is applicable to a plate-like material. Until now, it had been believed that it was difficult to apply the electroless ferrite plating method to particulate materials, because the ferrite forming reaction was carried out in a place other than on the particle surface to form mere ferrite particles. However, it has been found that, when it is applied to particles, the ferrite layer is mainly formed on the surface of the particles based on the activity of the surface of individual particles. It, also, has been found that, if nitrite is employed as an oxidizing agent in the method, the formation of the ferrite layer on the particles is accelerated.

According to the electroless ferrite plating method, the colored particles are uniformly dispersed in an aqueous solution containing some metal ions, at least ferrous ions, so that ferrous hydroxide ions ($FeOH^+$) or other metal hydroxide ions are uniformly absorbed onto the surface of the colored particles by means of the reaction occurring at the interface of the colored particles and the aqueous solution. Absorption $FeOH^+$ obtained through the procedures described above is, then, oxidized to $FeOH^{2+}$ so that crystallization reaction of ferrite or magnetite takes place between the above-described $FeOH^{2+}$ and other metal hydroxide ions in the aqueous solution, thereby generating crystalline layer on the surface of the colored particles. In the process of this method, ferrous ion hydroxide ions or other metal hydroxide ions are further adsorbed onto the crystalline layer thus generated. The thickness of the crystalline layer can be controlled by regulating the quantity of metal ion in the bath. Also, the electric conductivity of the generated magnetic crystalline layer is controlled by regulating the concentration of the ferrous ion hydroxide and the other metal ions in the bath.

In executing the electroless ferrite plating process, the dispersion solution containing the colored particles obtained by the particulated polymerization can be utilized without treating it thereafter; if colored particles are to be obtained by the melt-kneading method, the particles should be, in general, preferably dispersed uniformly in the ion-exchanged water in which a surfactant is dissolved, or the particles should be preferably impregnated by alcohol before uniformly dispersing the particles in the ion-exchanged water.

According to this plating method, an oxygen atom on the surface of the colored particles and ferrous ion or other transitional metals, such as $Zn^{2+}$, $Co^{2+}$, $Co^{3+}$, $Ni^{2+}$, $Mn^{2+}$, $Mn^{3+}$, $Fe^{3+}$, $Cu^{2+}$, $V^{3+}$, $V^{4+}$, $V^{5+}$, $Sb^{5+}$, $Li^+$, $Li^+$, $Mo^{4+}$, $Mo^{5+}$, $Ti^{4+}$, $Pd^{3+}$, $Mg^{2+}$, $Al^{3+}$, $Si^{4+}$, $Cr^{3+}$, $Sn^{2+}$, $Sn^{4+}$, etc. are combined to form chemical bond, thus forming consecutively ferrite cyrstal. The thickness of the magnetic shell to be formed should range from 0.001 to 1 micron, preferably from 0.005 to 0.5 micron. If the thickness exceeds over 1 micron, a thick layer is formed between paper and colored particles to deteriorate the fixability. If the thickness of the magnetic shell to be formed is under 0.001 micron, the mechanical strength of the magnetic shell becomes weak, causing blocking and the like due to destruction of the shell. It should be noted that the thickness of the magnetic-shell is calculated using the true specific gravity of the colored particles, magnetic-shell-coated toner and magnetic material.

The magnetic-shell-coated toner of the present invention has a crystal layer composed of iron-oxide type magnetic material; therefore, the toner is free from any damages caused by the mechanical shocks like agitation movement in the developing machine or thermal influence during storage or in the developing machine; thus the glass-transition temperature of the binder resin can be lowered when forming a toner. Accordingly, the low-temperature fixability as well as low-pressure fixability is improved. Also, when employing the electroless ferrite plating method for forming magnetic shell, the thickness of the shell can be easily controlled. Moreover, in the case of two-component-type toner, if the magnetic-shell-coated toner of the present invention is used, the dispersion of the toner is effectively prevented because of the effect of the magnetic material.

The present invention is illustrated by the following examples, which, however, are not construed as limiting the scope of the present invention to their details.

EXAMPLE 1

Production of Colored Particles

First, 150 parts of ion-exchanged water was poured into a polymerization-reaction container equipped with an agitator, a thermometer, a monomer-dropping funnel, a reflux condenser, a heater, and a nitrogen-introduction pipe. At the temperature of 80° C., one part by weight of a monomer mixture (A) containing styrene and 2-ethylhexyl acrylate in a weight ratio of 75:25 of styrene and 2-ethylhexyl acrylate, and 10 parts by weight of 10% ammonium persulfate water solution were added. Then, 99 parts of the above-described monomer mixture (A) was added dropwise for three hours, thereby obtaining a seed latex. The particles thus obtained were observed using an electron microscope. The diameter of the particles was uniform and had 0.6 micron.

Using the same system, 0.2 parts of the seed latex were first added to 250 parts of ion-exchanged water, then at the temperature of 80° C., 10 parts of a 10% ammonium-persulfate water solution and 100 parts of the monomer mixture (A) were added dropwise for 8 hours; thus, large-diameter latex particles were produced through a seed polymerization. Observation through an electron microscope showed that diameters of the particles ranged from 6 to 8 microns, and their shape was near to true sherical. By adding 50 parts of a 5% water solution of black dye, Sumi Acryl Black B (basic dye manufactured by Sumitomo Chemical Co., Ltd.) to the latex described above, and agitating the mixture for one hour, colored particles were obtained wherein the surface of the latex particles had absorbed dye.

The glass-transition temperature of the colored particles (I) was measured by DSC (differential scanning calorimeter: Daini Seikosha Co., Ltd. SSC/560), the result was 37° C.

Formation of a Magnetic Crystalline Layer

The amount of 180 g of the above-described colored particle emulsion (solid portion: 30%) was poured into a device equipped with an agitator, a thermometer, a metal-ion-dropping funnel, an heater, and a nitrogen-introduction pipe; then, nitrogen gas was introduced so as to removed oxygen contained in the emulsion. On the other hand, a ferrous-ion solution was obtained by means of dissolving 62 g of ferrous chloride into 62 ml of ion-exchanged water which previously removed oxygen by nitrogen gas. Also, a sodium-nitrite solution was prepared by dissolving 13 g of sodium nitrite into 330 g of ion-exchanged water which previously removed oxygen by nitrogen gas. Furthermore, an ammonium-acetate solution was obtained by dissolving 124 g of ammonium acetate into 430 g of ion-exchanged water which previously removed oxygen by nitrogen gas.

Next, the above-described ammonium acetate was added to the emulsion of the colored particles (I) and mixed sufficiently. Then, the total amount of the above-described ferrous ion solution was poured and heated to 70° C. at a pH of 6.5 to 7 under mixing in a nitrogen blanket, with maintaining at this condition, the total amount of the sodium-nitrite solution described above was then added dropwise at the rate of 10 to 20 ml/min to generate a magnetite crystalline layer on the surface of the colored particles. The obtained particles were dried by a spray-dryer to obtain a magnetic-shell-coated toner (I).

The obtained magnetic-shell-coated toner (I) was observed by an electron microscope, and it was found that magnetite crystal layer was uniformly formed on the surface of the particles. Also, the thickness of the magnetite crystal layer of the colored particles was calculated to evaluate 0.1 micron..

EXAMPLE 2

Using the colored particles (I) obtained in Example 1, a magnetic-shell-coated toner (I) was prepared as generally described in Example 1 with the exception that the dissolved amount of ferrous chloride was changed to 0.62 g, the dissolved amount of sodium-nitrite was changed to 0.13 g, and the dissolved amount of ammonium acetate was changed to 1.2 g. The obtained toner was observed by an electron microscope, and it was found that a magnetite crystal layer was almost formed. Also, the thickness of the magnetite crystal layer of the toner was calculated to find less than 0.0008 micron.

EXAMPLE 3

Using the colored particles (I) obtained in the Example 1, a magnetic-shell-coated toner (III) was prepared as generally described in Example 1 with the exception the amount of colored-particle emulsion (solid portion: 30%) was changed to 30 g, the dissolved amount of ferrous chloride was changed to 130 g, the dissolved amount of sodium-nitrite was changed to 27 g, and the dissolved amount of sodium acetate was changed to 260 g. The obtained toner was observed by an electron microscope, and it was found that magnetite crystal layer was uniformly formed on the surface of the colored particles. Also, the thickness of the magnetite crystal layer of the toner was calculated to find 1.2 micron.

EXAMPLE 4

Production of Colored Particles

Using the same type of reaction system employed in Example 1, colored particles having a particle diameter of 6 to 8 micron were prepared as generally described in Example 1 with the exception that the composition of the mixed monomer was changed to 60:40 of styrene and n-butyl acrylate. The glass-transition temperature of the obtained particles was measured using a D.S.C.; the result was 20° C.

Formation of a Magnetic Crystal Layer

Using the same system under the same conditions of Example 1, a magnetic-shell-coated toner (IV) was prepared as generally describe in Example 1, wherein a magnetite crystal layer was generated on the surface of the above-described colored particles, then the layer was dried by a spray dryer. The thickness of the crystal layer formed on the surface of the toner was 0.1 micron.

EXAMPLE 5

Production of Colored Particles

The colored particles (I) obtained in Example 1 was used.

Formation of a Magnetic Crystal Layer

Using the same system employed in Example 1, a magnetic-shell-coated toner (V) was prepared as generally described in Example 1 with the exception that the composition of the metal-ion solution was changed to the following equation, $Fe^{2+}:Mn^{2+}:Zn^{2+}=2:0.5:0.5$ (ferrous chloride, magnanese chloride, and zinc chloride, respectively), a ferrite crystal layer was generated on the surface of the colored particles and dried by a spray dryer. The thickness of the crystal layer formed on the surface of the obtained toner was 0.15 micron. Furthermore, as a result of atomic analysis, the composition of the ferrite layer was found to be $Mn_{0.1}.Zn_{0.3}.Fe_{2.6}.O_4$.

EXAMPLE 6

Production of Colored Particles

| Component | Weight |
|---|---|
| Styrene resin (Trade name "Piccolastic D-125" Hercules Co., Ltd.) | 85 (Weight ratio) |
| Carbon black (Trade name "Monarch 880" Cabot Corp.) | 8 (Weight ratio) |
| Polypropylene wax (Trade name "Biscole 550P" Sanyo Chemical Industry Co., Ltd.) | 7 (Weight ratio) |
| Oil black (Trade name "Bontron S-34" Orient Chemical Co., Ltd.) | 2 (Weight ratio) |

After carrying out a dry blending of the components described above for 12 hours using a ball mill, the mixture of the components was heated and kneaded by means of a biaxial extruding machine, wherein barrel temperature was set to 125° C. degrees. Then, the mixture of the components was finely ground using a pin mill and a jet mill, and an air classifier classified the particles into a specified ratio, i.e., the amount of particles having a diameter exceeding 20 micron was under 1% of the weight ratio, the amount of particles having a diameter less than 5 micron was under 1%, making the average diameter of the particles 10 micron, thus classified colored particles (III) were obtained.

Formation of a Magnetic Crystal Layer

The amount of 3.6 g of nonionic surfactant (Nonipole 100: Sanyo Chemical Industry Co., Ltd.) was dissolved into 180 ml of ion-exchanged water, then 60 g of the colored particles (III) was gradually added and uniformly dispersed while the mixture was agitated at a rotation velocity of 1000 to 1500 r.p.m. Then, removal of oxygen was carried out simultaneously with the defoaming process performed by a vacuum deaerator, and the mixture was poured into the magnetic-material-generating system employed in Example 1, wherein crystallization was accomplished under the same conditions of Example 1 to obtain a magnetic-shell-coated toner (VI).

The obtained toner (VI) was observed by an electron microscope, and it was found that magnetite crystal layer was uniformly formed on the surface of the colored particles; the thickness of the magnetite crystal layer of the toner was 0.1 micron.

COMPARATIVE EXAMPLE 1

The colored particles (I) obtained in Example 1 were subjected to a conventional silica treatment to obtain a toner (VII).

COMPARATIVE EXAMPLE 2

| Component | Weight |
|---|---|
| Styrene resin (Trade name "Piccolastic D-125" Hercules Co., Ltd.) | 85 (Weight ratio) |
| Carbon black (Trade name "Monarch 880" Cabot Corp.) | 8 (Weight ratio) |
| Polypropylene wax (Trade name "Biscole 550P" Sanyo Chemical Industry Co., Ltd.) | 7 (Weight ratio) |
| Oil black (Trade name "Bontron S-34" Orient Chemical Co., Ltd.) | 2 (Weight ratio) |

After carrying out a dry blending of the components described above for 12 hours using a ball mill; the mixture of the components was heated and kneaded by means of a biaxial extruding machine, wherein barrel temperature was set to 125° C. Then, the mixture of the components was finely ground using a pin mill and a jet mill, and an air classifier classified the particles into a specified ratio, i.e., the amount of particles having a diameter exceeding 20 micron was under 1% of the weight ratio, the amount of particles having a diameter less than 5 micron was under 1%, making the average diameter of the particles 9.5 micron; furthermore, the particles was subjected to a conventional silica treatment to form colored particles (VIII).

Table 1 shows the results of the performance evaluation as for eight kinds of toners obtained in Examples 1 to 6, and Comparative Examples 1 to 2.

In evaluating fixability and image quality, resin-coated iron powder was used as a carrier for toners (I) to (IV), and toners (VI) to (VIII), wherein the weight ratio of a toner and a carrier was set to 4:96. In this way, developers (I), (II), (III), (IV), (V), (VI), (VII), and (VIII) were prepared and provided. As for toner (V), however, the evaluation was made as an one-component toner.

sample tube and was spreaded on a sheet of paper for observation.

TABLE 1

| | | Performance of toners | | | | | | | |
|---|---|---|---|---|---|---|---|---|---|
| | | Example 1 | Example 2 | Example 3 | Example 4 | Example 5 | Example 6 | Comparative Example 1 | Comparative Example 2 |
| Type of toner | | I | II | III | IV | V | VI | VII | VIII |
| Type of developer | | I | II | III | IV | — | VI | VII | VIII |
| Average particle diameter (micron) | | 7.2 | 7.1 | 7.8 | 6.8 | 7.3 | 10 | 7.0 | 9.5 |
| Thickness of magnetic layer | | 0.1 | 0.0008 | 1.2 | 0.1 | 0.15 | 0.1 | — | — |
| Glass-transition temperature of colored particles (°C.) | | 37 | 37 | 37 | 20 | 37 | 46 | 37 | 52 |
| Fixable temperature (°C.) | | 120 | 120 | 160 | 15 | 120 | 150 | 120 | 180 |
| Blocking resitance | | Normal | Partial agglomeration | Normal | Normal | Normal | Normal | Agglomeration | Normal |
| Initial performance | Resolution | 5 | 5 | 5 | 5 | 5 | 5 | 5 | 5 |
| | Fog | Not detected | Not detected | Not detected | Not detected | Not detected | Not detected | Not detected | Not detected |
| After accomplishing life-time test | Resolution | 5 | — | 5 | 5 | 5 | 5 | 3.5 | 4 |
| | Fog | Not detected | — | Not detected | Not detected | Not detected | Not detected | — | Fog in total area |
| | Toner condition in developing machine | Normal | Agglomeration | Normal | Normal | Normal | Normal | Agglomeration | Soft agglomeration |
| Fixation method | | Heat roller fixation | Heat roller fixation | Heat roller fixation | Pressume fixation | Heat roller fixation | Heat roller fixation | Heat roller fixation | Heat roller fixation |

NOTE

Evaluation Method (1) Average particle diameter: Colter counter (Toshiba Chemical Co., Ltd.)

(2) Glass-transition temperature of colored particles: DSC method (SSC/560 Daini Seikoosha DCol, Ltd.)

(3) Fixable temperature:

A non-fixed image was prepared by using U-Bix V (Konishiroku Photo Industry Co., Ltd.), then fixation was carried out by a temperature-variable fixation-testing machine (pressure 2 Kg/cm$^2$) comprising a teflon upper roller and a silicon lower roller. Then, rubbing the fixed image with a load of 2 Kg ten times using a plastic rubber, and image density of the rubbed portion and non-rubbed portion was compared. In this way, a fixable temperature was set to a temperature at which no difference in image density was recognized.

As for toner (IV), after obtaining a non-fixed image, fixation was carried out under the condition of 20 Kg/cm loaded by a pair of metal rollers.

As for toner (V), after obtaining a non-fixed image using U-Bix T (Konishiroku Photo Industry Co., Ltd.), fixation was carried out by a fixation-testing machine.

(4) Blocking resistance:

After slightly tapping a 50 ml sample tube containing 30 g of a toner, the tube was left in an incubator for 24 hours which was maintained at a temperature of 50° C. Then, the toner was taken out from the sample tube and was spreaded on a sheet of paper for observation.

(5) Life-time test:

Consecutive copying operation, 10,000 times, was carried out.

(6) Toner condition in developing machine: Visual inspection.

(7) Development degree, fog: Visual inspection.

What is claimed is:

1. A toner comprising a colored particle and a magnetic shell coated thereon, wherein said colored particle has a diameter of 2 to 30 microns and comprises a binder resin and a coloring agent, and said magnetic shell is an iron oxide type material having a thickness of 0.001 to 1 micron formed by an electroless ferrite plating method which comprises uniformly absorbing ferrous ions on the surface of said colored particles and oxidizing said ferrous ions by an oxidizing agent.

2. The toner as claimed in claim 1, wherein said iron-oxide type material is ferrite.

3. The toner as claimed in claim 2, wherein said ferrite is magnetite.

4. The toner as claimed in claim 1, wherein said colored particle is prepared by a melt-kneading method or a particulated polymerization method.

5. The toner as claimed in claim 4, wherein said particulated polymerization method is suspension polymerization or emulsion polymerization.

6. The toner as claimed in claim 1, wherein said binder resin has a glass transition temperature of 20° to 80° C.

7. The toner according to claim 1 wherein said electroless ferrite plating method is carried out using a nitrite salt as the oxidizing agent.

* * * * *